US008528997B2

(12) United States Patent
Grabherr

(10) Patent No.: US 8,528,997 B2
(45) Date of Patent: Sep. 10, 2013

(54) SUPPORT CONSTRUCTION FOR AT LEAST ONE FURNITURE DRIVE

(75) Inventor: Simon Grabherr, Höchst (AT)

(73) Assignee: Julius Blum GmbH, Hochst (AT)

( * ) Notice: Subject to any disclaimer, the term of this patent is extended or adjusted under 35 U.S.C. 154(b) by 174 days.

(21) Appl. No.: 12/759,884

(22) Filed: Apr. 14, 2010

(65) Prior Publication Data

US 2010/0194256 A1 Aug. 5, 2010

Related U.S. Application Data

(63) Continuation of application No. PCT/AT2008/000327, filed on Sep. 15, 2008.

(30) Foreign Application Priority Data

Nov. 7, 2007 (AT) ..... A 1791/2007

(51) Int. Cl.
*A47B 95/02* (2006.01)

(52) U.S. Cl.
USPC ..... 312/319.6

(58) Field of Classification Search
USPC ..... 312/319.1, 319.5, 319.6, 319.7, 348.4; 248/419, 424, 429, 298.1; 292/137, 138, 292/142, 279, DIG. 60
See application file for complete search history.

(56) References Cited

U.S. PATENT DOCUMENTS

| | | | | |
|---|---|---|---|---|
| 1,153,385 | A | 9/1915 | Hoffelt | |
| 3,765,633 | A * | 10/1973 | Caudill | 248/229.12 |
| 5,002,346 | A * | 3/1991 | Gasser | 312/348.4 |
| 5,779,206 | A * | 7/1998 | Harris et al. | 248/214 |
| 6,234,596 | B1 * | 5/2001 | Egger | 312/348.4 |
| 2003/0173483 | A1 * | 9/2003 | Yeh | 248/287.1 |
| 2007/0145867 | A1 | 6/2007 | Gasser | |

FOREIGN PATENT DOCUMENTS

| | | |
|---|---|---|
| DE | 3643312 A1 * | 6/1988 |
| DE | 20 2006 006 189 | 10/2007 |
| JP | 57-27354 | 6/1982 |
| JP | 5-56839 | 3/1993 |
| JP | 2004-89590 | 3/2004 |
| JP | 2007-252491 | 10/2007 |
| WO | 00/01278 | 1/2000 |
| WO | 2006/017864 | 2/2006 |
| WO | 2006/017865 | 2/2006 |
| WO | 2008/101261 | 1/2008 |
| WO | 2008/101261 | 8/2008 |

OTHER PUBLICATIONS

Machine Translation of DE 3643312, printed Sep. 21, 2012.*
International Search Report issued Jan. 26, 2009 in International (PCT) Application No. PCT/AT2008/000327.
Austrian Search Report issued Apr. 30, 2008 in Austrian Applicant No. A 1791/2007.

* cited by examiner

*Primary Examiner* — Janet M Wilkens
*Assistant Examiner* — Matthew Ing
(74) *Attorney, Agent, or Firm* — Wenderoth, Lind & Ponack, L.L.P.

(57) ABSTRACT

A support construction for at least one furniture drive includes a support rail for bearing the at least one furniture drive and a first and a second fixing device for fixing the support rail to an item of furniture. At least one of the fixing devices includes a mounting part to be fixed to the item of furniture and a bearing part that can be connected to the support rail. The mounting part and the bearing part can be displaced in relation to each other and can be releasably locked by a locking device.

18 Claims, 7 Drawing Sheets

SUPPORT CONSTRUCTION FOR AT LEAST ONE FURNITURE DRIVE

This application is a continuation application of pending International application PCT/AT2008/000327, filed Sep. 15, 2008.

BACKGROUND OF THE INVENTION

The present invention relates to a support construction for at least one furniture drive, comprising a support rail for bearing the at least one furniture drive and first and second fixing devices for fixing the support rail to an item of furniture.

The invention further concerns an item of furniture having a support construction of the kind to be described.

Such support constructions comprising a support rail for bearing a furniture drive are used in particular in relation to items of furniture in cabinet form with one or more drawers to move the drawer by the furniture drive from a closed position into an open position. For that purpose, the furniture drive is disposed in the immediate proximity of the rear wall of the respective drawer. An ejection element acts on the rear wall of the drawer so that the drawer is urged into an open position. Stable mounting of the respective furniture drive is required for that purpose. In many cases, however, the furniture body or carcass does not have a stable rear wall so that the use of a support rail for bearing the furniture drive has proven to be desirable. That support rail, however, must be arranged at a defined spacing relative to the rear wall of the drawer, particularly when the furniture drive is equipped with a Touch-latch functionality. With such a Touch-latch functionality, the drawer in the closed condition can be moved into an end position in which it is displaced further into the furniture carcass, when manual pressure is applied to the front panel, whereby the Touch-latch function of the furniture drive is activated and the drawer is ejected into an open position. For that purpose, a defined triggering travel movement is required for activation of the Touch-latch function, which presupposes a correct position for the support rail.

SUMMARY OF THE INVENTION

It is therefore an object of the present invention to provide convenient and precise mounting of the support rail to an item of furniture.

According to the invention, that object is achieved in that at least one of the fixing devices has a mounting portion for fixing to an item of furniture and a bearing portion which can be connected to the support rail. The mounting portion and the bearing portion are movable relative to each other and are releasably arrestable (clampable) by an arresting device.

The fixing device with the adjustment option is preferably arranged in the upper region of the item of furniture. The mounting portion is associated with a substantially stable carcass portion, and the bearing portion is associated with the support rail. When the support construction is fitted, a drawer can be moved completely into the carcass of the item of furniture, as calibration for correct positioning of the support rail, in which case the rear wall of the drawer moves the support rail which has not yet been arrested, by way of the furniture drive, to the correct position. Thus, that preset position between the bearing portion and the mounting portion (and thus the support rail) can be definitively fixed by way of the arresting device provided.

For that purpose, it is desirably provided that the relative mobility between the bearing portion and the mounting portion is such that the bearing portion is mounted limitedly movably relative to the mounting portion in a direction which extends at least approximately at a right angle to the longitudinal extent of the support rail. In that connection, it may be advantageous if the bearing portion is mounted linearly movably relative to the mounting portion. In addition, it may be advantageous if the relative spacing between the bearing portion and the mounting portion can be continuously adjusted within predetermined limits.

In accordance with a possible embodiment of the invention, the arresting device can have a movable clamping element—preferably an eccentric lever—by which the relative position of the bearing portion relative to the mounting portion can be clampingly fixed. In an advantageous development of the invention, in the course of the arresting process, the relative position between the bearing portion and the mounting portion can be altered by a predetermined travel distance. That is advantageous, in particular, when the furniture drive is based on a Touch-latch functionality. In that way, the triggering travel required for the Touch-latch function can be ensured when fitting the support rail. In that case, to calibrate the correct position of the support rail, a drawer is pushed completely into the carcass of the item of furniture so that the rear wall of that drawer presses the support rail which has not yet been arrested, into the carcass of the item of furniture, until the front panel of the drawer abuts against the front edge of the carcass. If now the support rail were to be arrested precisely at that location, the required triggering travel for activation of the Touch-latch functionality would not be afforded beyond all doubt. For that reason, the support rail can still be pushed somewhat away from the rear wall of the drawer by the proposed arresting device during the arresting process when the drawer is completely closed so that the triggering travel (for example 2.5 mm) for unlocking the Touch-latch function is certain to be guaranteed and at the same time that correct position between the bearing portion and the mounting portion can be fixed.

In structural terms, that can be achieved if the eccentric lever has a screwthread portion which in the arresting process can be brought into engagement with a corresponding screwthread portion of the bearing portion or the mounting portion so that the bearing portion can be drawn in the direction of the mounting portion over the predefined travel distance. Desirably, the screwthread portion is designed so that the eccentric lever has a first operating position in which the bearing portion is substantially freely displaceable within predetermined limits relative to the mounting portion. In a second operating position—for example, after half a revolution of the eccentric lever—it arrests the relative position as between the bearing portion and the mounting portion, in which case at the same time the position as between the bearing portion and the mounting portion can be altered—preferably reduced in size—so that the predefined distance for ensuring the triggering travel of the Touch-latch function can be produced.

In accordance with a preferred configuration of the invention, the support rail can be adapted for the, preferably releasable, arrangement of one or more furniture drives. In that respect, the furniture drive includes at least one spring or at least one electric motor, by which at least one ejection element is or can be acted upon, for ejection of a movable portion of the item of furniture. In that respect, the configuration can be such that the movable portion of the item of furniture is a drawer arranged movably relative to a carcass of the item of furniture, wherein the drawer has a first end position corresponding to the closed position thereof and the drawer, starting from that first end position, is movable by the application of pressure in the closing direction of the drawer into a second end position—which is displaced further into the carcass of the item of furniture. The drawer is thus movable by the furniture drive, starting from the second end position, into an open position. That mechanism is generally known as a Touch-latch function and does not need to be described in greater detail at this juncture.

It will be appreciated that the proposed support construction can also be used for other electrical or mechanical components of the item of furniture.

The item of furniture according to the invention is characterised by the support construction of the described kind.

BRIEF DESCRIPTION OF THE DRAWINGS

Further details and advantages of the present invention are described with reference to the specific description hereinafter. In the drawings.

DETAILED DESCRIPTION OF THE INVENTION

Figure 1:
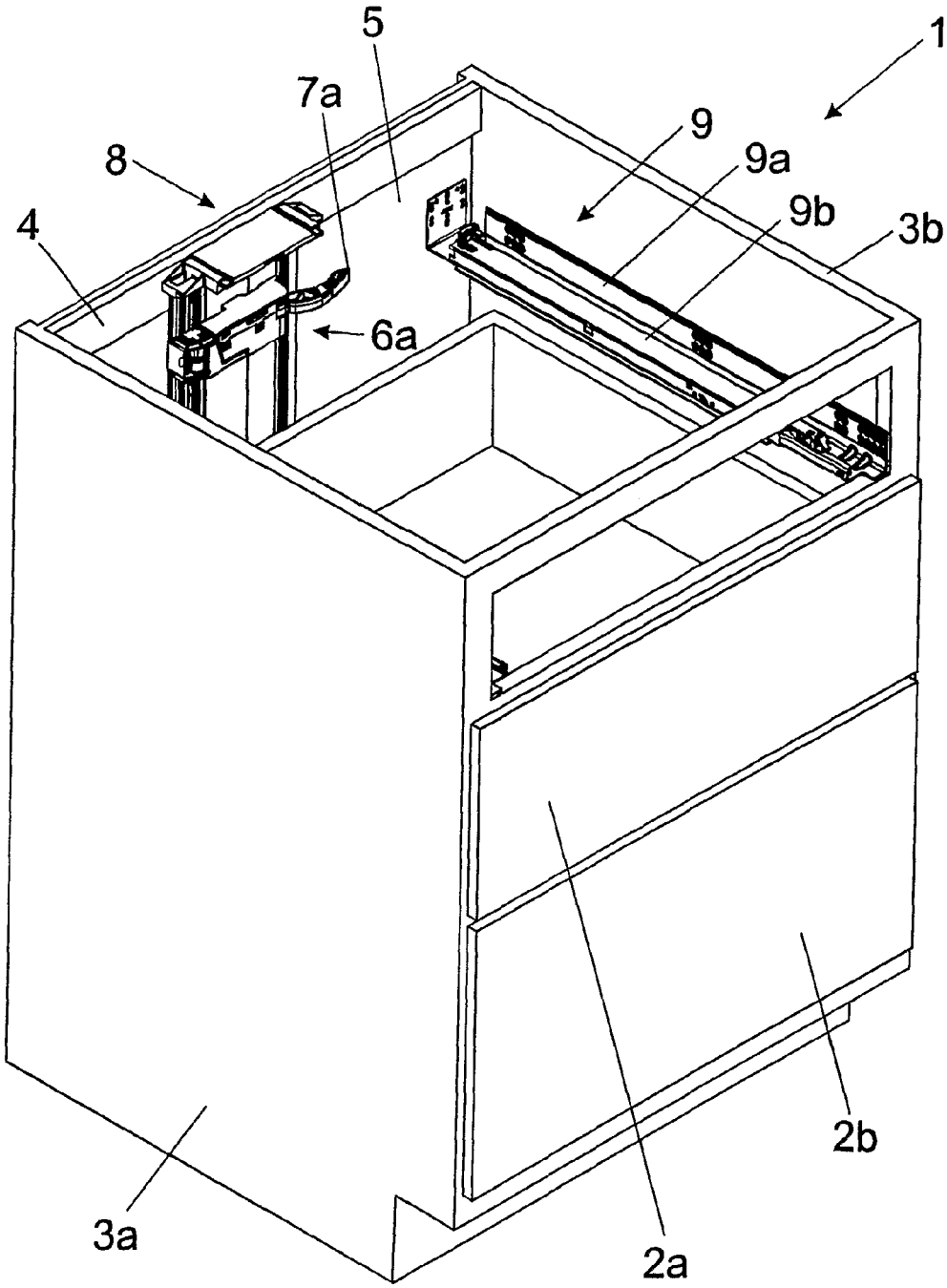
FIG. 1 shows a perspective view of an item of furniture in cabinet form with a support construction according to the invention.

FIG. 1 shows a perspective view of an item of furniture 1 in cabinet form, with extendable drawers 2*a* and 2*b*. For reasons of clarity of the drawing, the uppermost drawer has been removed. The item of furniture 1 has a furniture carcass with side walls 3*a* and 3*b*, and a transverse bar 4 arranged at the rear side. The rear closure of the item of furniture 1 is formed by a rear wall 5 which, however, is frequently in the form of a relatively unstable molded fiber board or can be entirely omitted. The fact that the rear wall 5 is omitted or is of an unstable nature however causes difficulty in mounting of the furniture drive 6*a* which is preferably in the form of a Touch-latch furniture drive, wherein an ejection lever 7*a* can be pressed against the rear side of the rear wall of the respective drawers 2*a*, 2*b* and thereby moves them into an open position. For stable and accurately positioned mounting of one or more furniture drives 6*a*, there is provided a support construction 8 which will be described in greater detail with reference to the following Figures. For displaceable mounting of the drawers 2*a*, 2*b*, the arrangement has usual extension guides 9 with a support rail 9*a* which is fixed with respect to the carcass and at least one extension rail 9*b* which is displaceable relative thereto.

Figure 2:
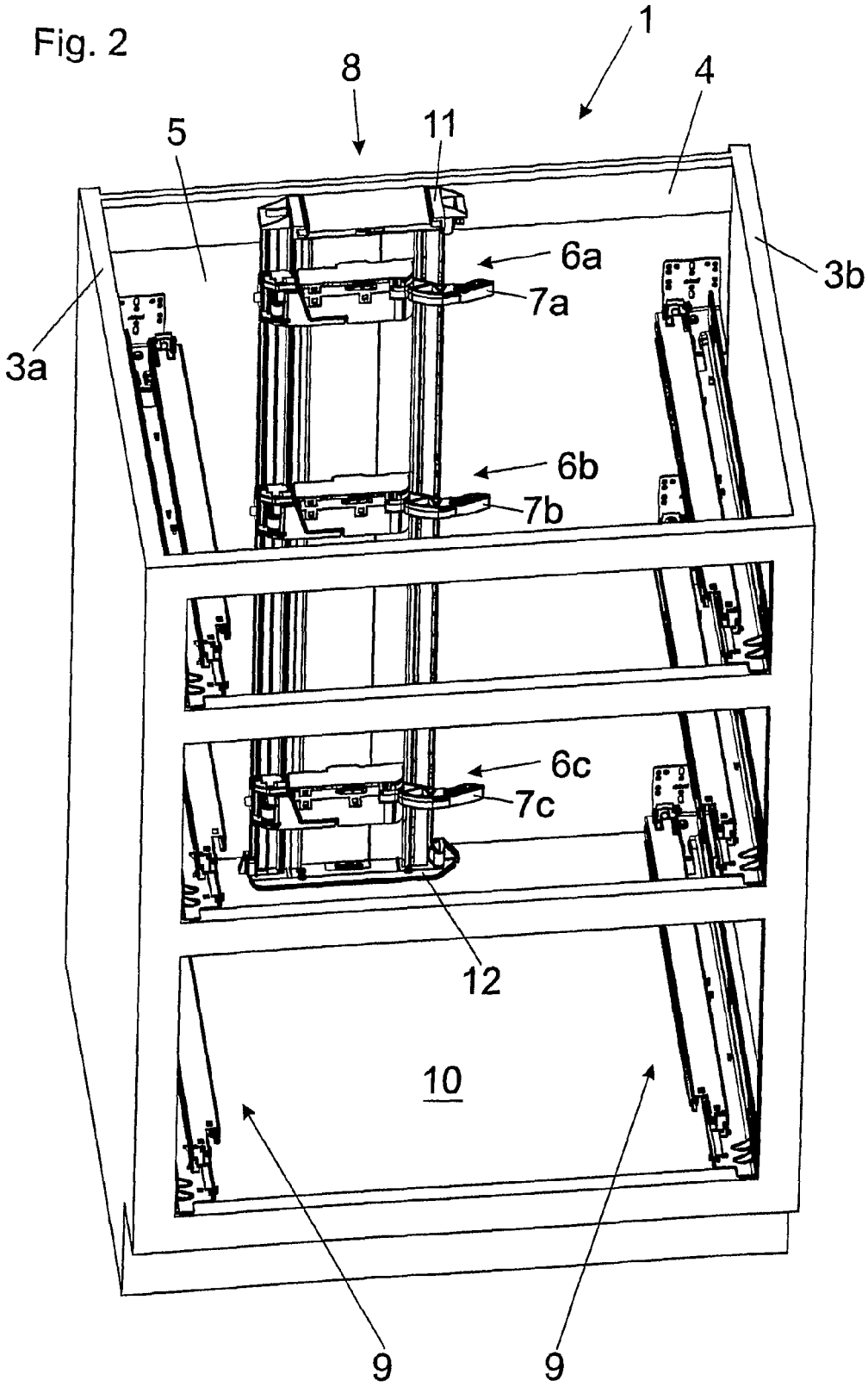
FIG. 2 shows the item of furniture of FIG. 1, with all drawers removed.

FIG. 2 shows the item of furniture 1 of FIG. 1, with all drawers 2*a*, 2*b* having been removed. For displaceably mounting the drawers 2*a*, 2*b* with respect to the furniture carcass, there are provided extension guides 9 which in the illustrated embodiment extend between a front edge of the carcass and the rear wall 5. Disposed at the rear side of the item of furniture 1 is a relatively strong and stable transverse bar 4 serving for fixing the support construction 8. In the illustrated embodiment, the support construction 8 is mounted by two fixing devices 11 and 12 between the transverse bar 4 and the cabinet bottom 10 so that the rear wall 5 can be designed to be of a lightweight structure or can also be completely omitted. The fixing devices 11, 12, respectively, receive the opposite ends of a vertical support rail 13. It can however also be provided that the fixing devices 11, 12 are disposed at any location along the longitudinal extent of the support rail 13. The stable support rail 13 is preferably made of metal and has a profiling so that the respective furniture drives 6*a*, 6*b*, 6*c* can be releasably connected to the support rail 13 and can preferably be latched thereto. The furniture drives 6*a*, 6*b*, 6*c* each have a respective ejection lever 7*a*, 7*b*, 7*c* for ejection of the drawer associated therewith.

Figure 3:
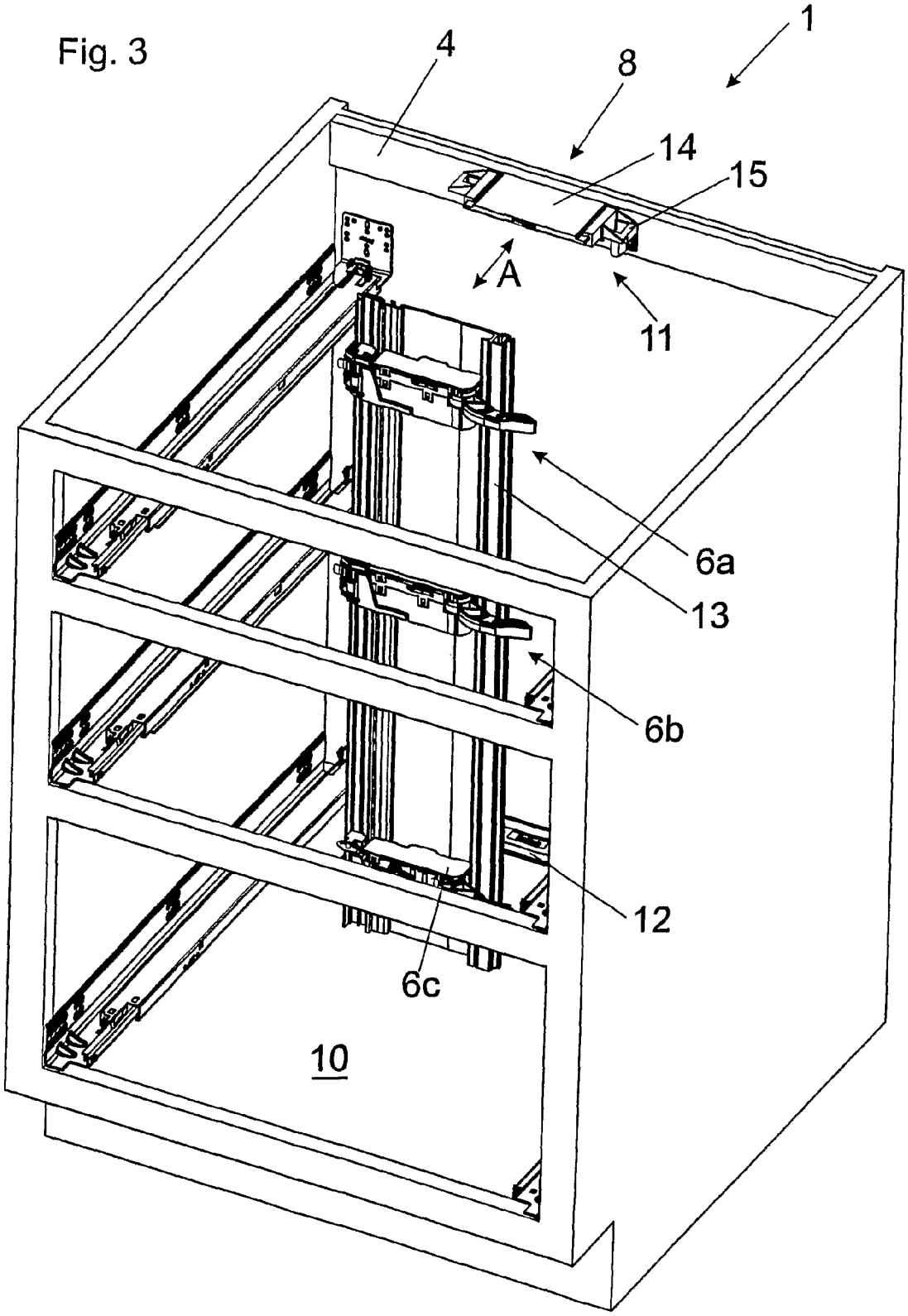
FIG. 3 shows the item of furniture with the support construction for the support rail to be mounted.

FIG. 3 shows the item of furniture 1 with the support construction 8 and the support rail 13 which is to be mounted, being provided to support the furniture drives 6*a*, 6*b*, 6*c*. The support construction 8 also includes the two fixing devices 11 and 12, wherein, in a first mounting step, the first fixing device 11 is fixed to the stable transverse bar 4 and the second fixing device 12 is fixed to the cabinet bottom 10 at a defined location (for example by being correctly measured off). The fixing device 11 comprises a mounting portion 14 to be mounted to the transverse bar 4 and a bearing portion 15 which is displaceable relative thereto, for receiving the upper end of the support rail 13. In that way, the support rail 13 can be limitedly movably supported in a direction A which is at least approximately at a right angle to the longitudinal extent of the support rail 13, in accordance with the double-headed arrow shown, while the fixing device 12 mounted at the cabinet bottom 10 can provide a substantially positionally stable receiving means for the lower end of the support rail 13.

Figure 4:
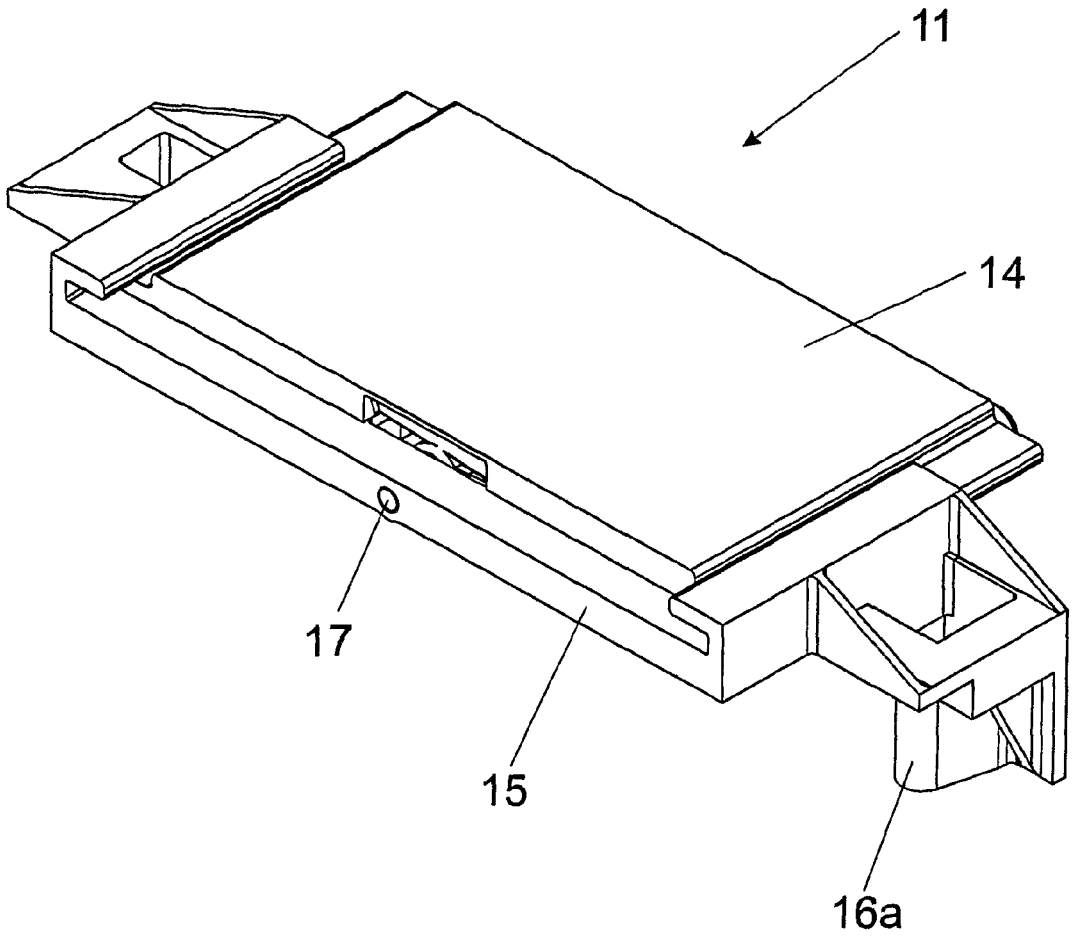
FIG. 4 shows a fixing device with a mounting portion which is fixed with respect to the carcass and a bearing portion which is displaceable relative thereto for the support rail in the assembled condition.

FIG. 4 shows the assembled condition of the first fixing device 11 to be mounted at the upper end of the item of furniture 1. That first fixing device 11 has a mounting portion 14 which is to be fixedly connected to the transverse bar 4 shown in FIG. 3. A bearing portion 15 for receiving the support rail 13 is mounted displaceably relative thereto. The bearing portion 15 has at least one holding device 16*a* for the support rail 13 to be mounted. It is possible to see a spindle 17 for mounting a clamping element (not visible here), with which it is possible to provide for arresting of the bearing portion 15 and the mounting portion 14, and with which it is possible to simultaneously alter the relative position as between the bearing portion 15 and the mounting portion 14 by a predefined travel distance.

Figure 5A:
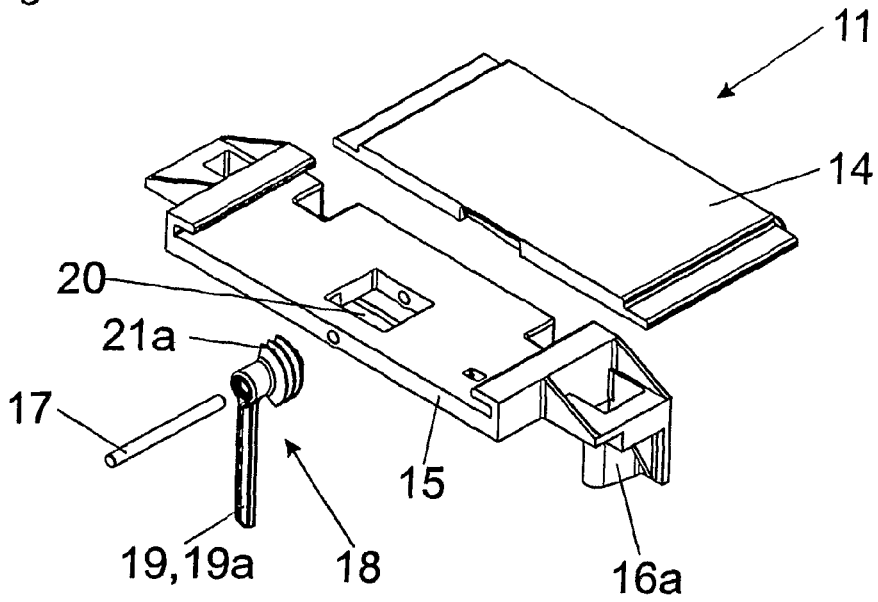
FIGS. 5*a*, 5*b* show perspective views of a fixing device from above and from below.
Figure 5B:
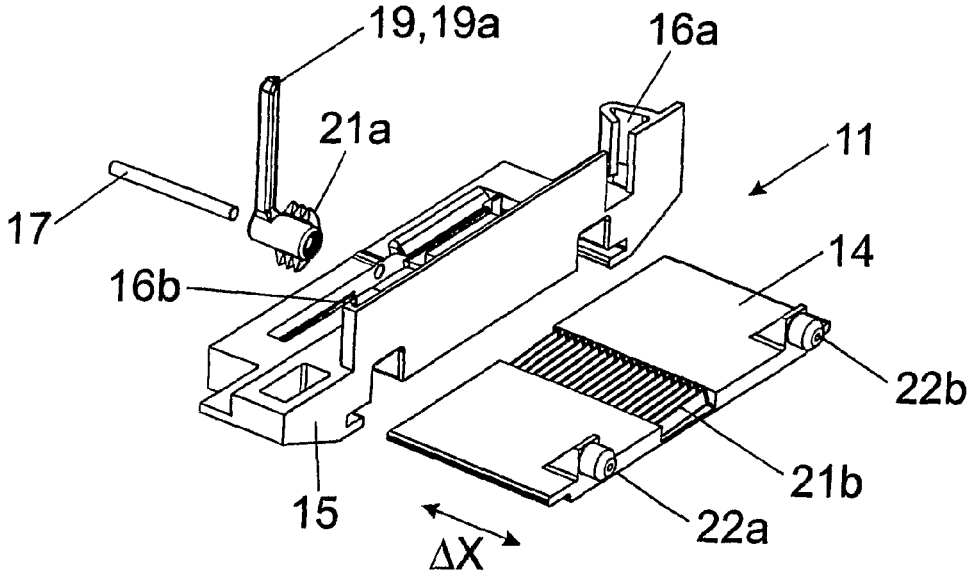

FIG. 5*a* shows a perspective view from above while FIG. 5*b* shows a perspective view from below, of the first fixing device 11. FIG. 5*a* shows the mounting portion 14 which is fixed with respect to the carcass in the mounting position and the bearing portion 15 which is displaceable relative thereto, with a holding device 16*a* for the support rail 13 (not shown here). The bearing portion 15 is provided with an arresting device 18 which, in the illustrated embodiment, includes a clamping element 19, mounted to the spindle 17, in the form of an eccentric lever 19*a*. The clamping element 19 is received in an opening 20 in the bearing portion 15. It will be seen that the eccentric lever 19*a* has an approximately semi-circular screwthread portion 21*a*, the function of which is illustrated with reference to FIG. 5*b*. More specifically, at its underside, the mounting portion 14 which is fixed with respect to the carcass (furniture part) has a corresponding screwthread portion 21*b*. In order to mount the support rail 13, a drawer (for example drawer 2*a* in FIG. 1) is pushed into the carcass of the item of furniture, the rear side of the drawer 2*a* presses against the furniture drive 6*b* (FIG. 2) so that the support rail 13 is also spaced from the rear side of the drawer 2*a*. When the drawer 2*a* is pushed completely into the carcass of the item of furniture, the support rail 13 (and therewith the bearing portion 15 relative to the mounting portion 14) is in a provisional position, with the clamping element 19 being disposed in a released position. If now, starting from that provisional position, the clamping element 19 is rotated through half a revolution, then the screwthread portion 21*a* of the clamping element 19 comes into releasable engagement with a corresponding screwthread portion 21*b* of the mounting portion 14, whereupon the mounting portion 14 is releasably and adjustably clamped to the bearing portion 15. The bearing portion 15 is drawn in by a predefined travel distance ΔX relative to the mounting portion 14 so as to ensure the necessary triggering travel for the Touch-latch function of the furniture drive 6*a*. It will be seen that there are pegs 22*a* and 22*b* for fixing the mounting portion 14 to an item of furniture 1. The bearing portion 15 has holding devices 16*a* and 16*b*, in which a respective side edge of the support rail 13 is received.

Figure 6:
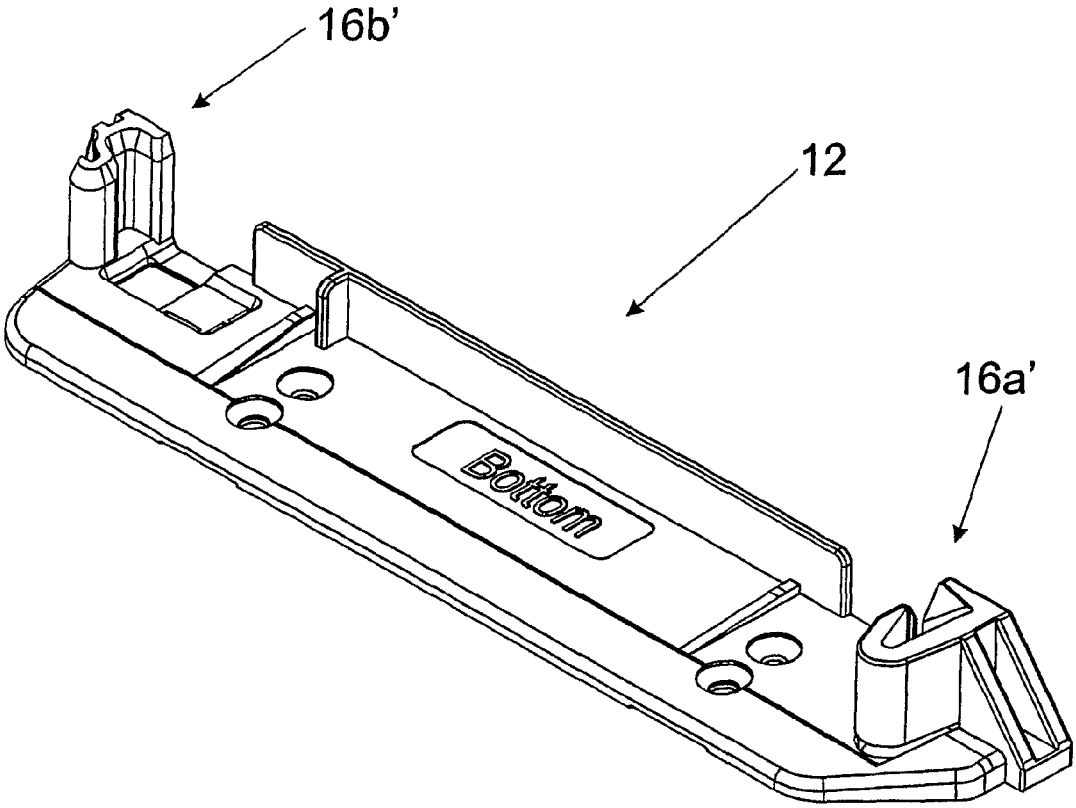
FIG. 6 shows a perspective view of the fixing device to be mounted to the cabinet bottom.

FIG. 6 shows a perspective view of the lower (second) fixing device 12 which is to be mounted to the cabinet bottom 10 and in respect of which a displacement option for the support rail 13 is not compulsory necessary. Provided for detachably receiving the side edges of the support rail 13 are holding devices 16*a*' and 16*b*' which can substantially correspond to the holding devices 16*a* and 16*b* of the upper fixing device 11.

Figure 7A:
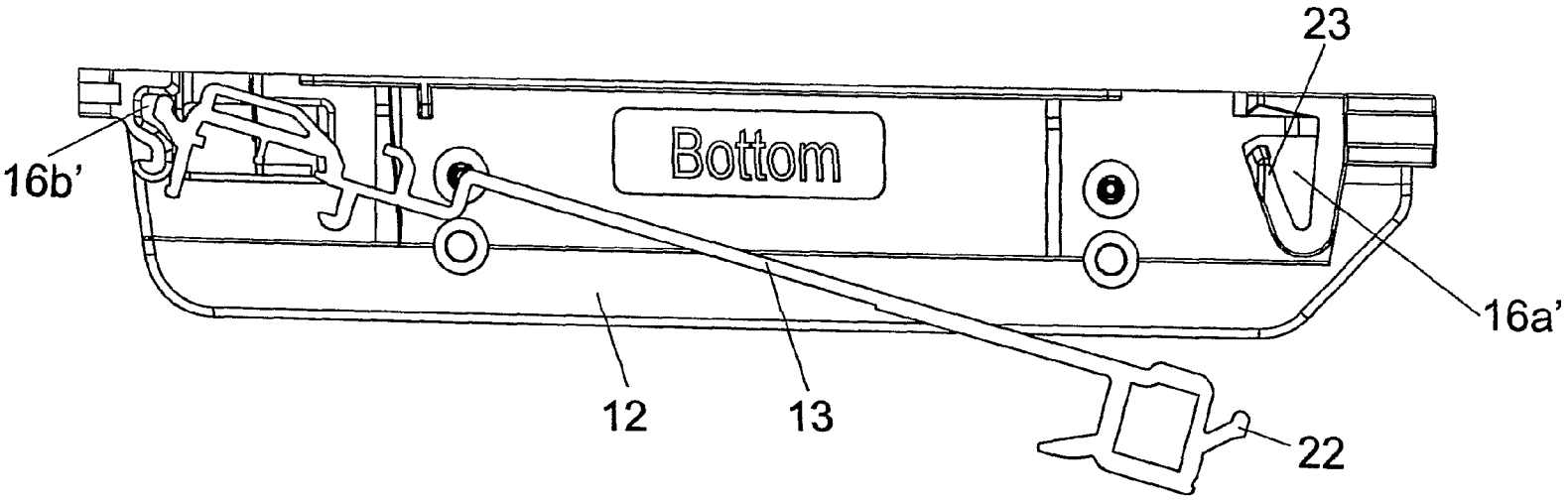
FIGS. 7*a*, 7*b* show sectional views of the fixing device to be mounted at the cabinet bottom, with a support rail engaged therein and completely latched in place.
Figure 7B:
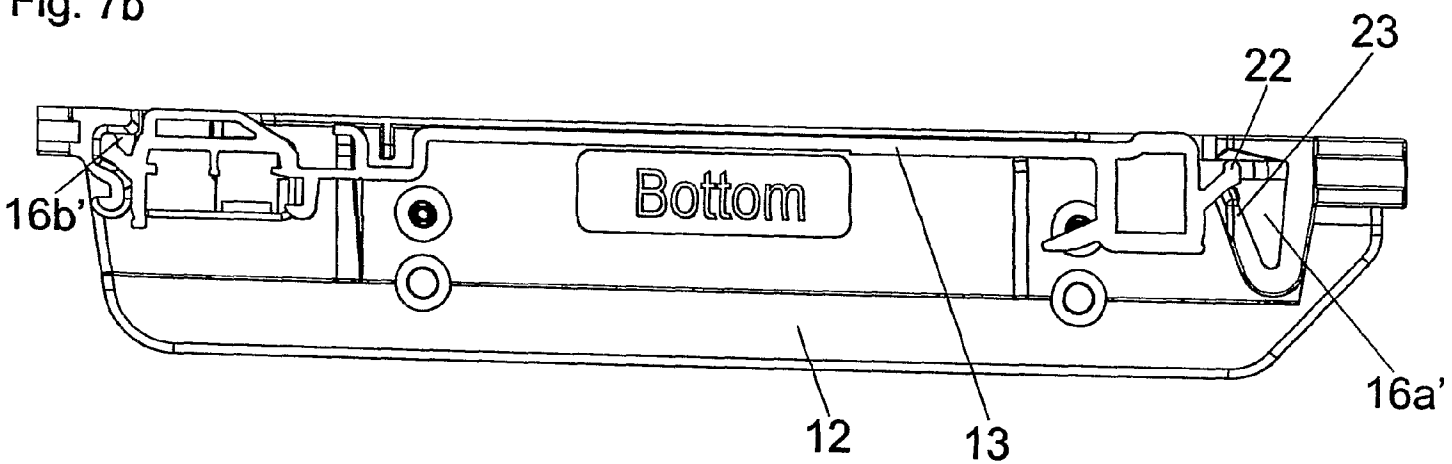

FIG. 7*a* shows a horizontal section through the fixing device 12 to be mounted to the cabinet bottom 10, with a side edge of the support rail 13 already engaged into the holding device 16*b*'. A projection 22 of the support rail 13 can pass over a resilient tang 23 of the holding device 16*a*' by pivotal movement of the upstanding support rail 13 about a vertical axis so that the support rail 13 is detachably held within the two holding devices 16*a*' and 16*b*'. The projection 22 can jump out of (be detached from) the tang 23 again by pulling out the support rail 13 so that the support rail 13 can be disassembled. FIG. 7*b* shows the latched condition as between the support rail 13 and the lower fixing device 12.

The invention is not limited to the illustrated embodiment, but embraces or extends to all variants and technical equivalents which can fall within the scope of the following claims. The positional references adopted in the description, such as for example up, down, lateral and so forth also relate to the Figure being directly described and illustrated and upon a change in position are to be appropriately transferred to the new position.

The invention claimed is:

1. A support construction comprising:

a support rail;

a furniture drive mounted on said support rail;

a first fixing device for attaching a first end of said support rail to an item of furniture, an entirety of said first fixing device being detachably connected to said first end of said support rail; and a second fixing device for attaching a second end of said support rail to the item of furniture, an entirety of said second fixing device being detachably connected to said second end of said support rail;

wherein at least one of said first fixing device and said second fixing device includes:

a mounting portion to be fixed to the item of furniture;

a bearing portion detachably connected to said support rail; and an arresting device for releasably and adjustably clamping said mounting portion to said bearing portion, said arresting device having a movable eccentric lever mounted rotatably about an axis, a position of said bearing portion relative to a position of said mounting portion being clamped and held by said eccentric lever, said eccentric lever comprising a screwthread portion configured to be brought into engagement with a corresponding screwthread portion of one of said bearing portion and said mounting portion during a clamping process so that said bearing portion is drawn toward said mounting portion over a predefined travel distance.

2. The support construction according to claim 1, wherein said bearing portion is configured and arranged so as to have limited movement relative to said mounting portion in a direction extending approximately at a right angle to a longitudinal axis of said support rail.

3. The support construction according to claim 1, wherein said bearing portion is configured and arranged so as to be linearly movably relative to said mounting portion.

4. The support construction according to claim 1, wherein a relative spacing between said bearing portion and said mounting portion is continuously adjustable within predetermined limits.

5. The support construction according to claim 1, wherein said at least one of said first fixing device and said second fixing device is configured such that, during a clamping process, a relative position between said bearing portion and said mounting portion is variable by a predefined travel distance.

6. The support construction according to claim 1, wherein said furniture drive comprises a first furniture drive mounted on said support rail, further comprising a second furniture drive mounted on said support rail.

7. The support construction according to claim 1, wherein said furniture drive is configured to move a movable furniture portion from a closed position into an open position.

8. The support construction according to claim 1, wherein said furniture drive is configured to move a drawer from a closed position into an open position.

9. The support construction according to claim 1, wherein said first fixing device includes said mounting portion, said bearing portion, and said arresting device, said second fixing device comprising two holding devices for holding said support rail therebetween, at least one of said holding devices having a tang for engaging a projection of said support rail.

10. An item of furniture comprising:

a furniture carcass;

said support construction of claim 1 mounted to said furniture carcass; and a movable furniture portion to be moved by said furniture drive of said support construction.

11. The item of furniture according to claim 10, wherein said furniture drive includes one of a spring and an electric motor for acting upon an ejection element for ejecting said movable furniture portion.

12. The item of furniture according to claim 10, wherein said movable furniture portion comprises a drawer displaceable relative to said furniture carcass, said drawer having a first end position corresponding to a closed position thereof, said drawer starting from said first end position being movable by an application of pressure in a closing direction thereof into a second end position located further inside said furniture carcass, said drawer being movable by said furniture drive from said second end position into an open position.

13. The item of furniture according to claim 10, wherein said support rail extends substantially over an entire height of said furniture carcass and is mounted substantially vertically.

14. A support construction comprising:

a support rail;

a furniture drive mounted on said support rail;

a first fixing device for attaching a first end of said support rail to an item of furniture, an entirety of said first fixing device being detachably connected to said first end of said support rail; and a second fixing device for attaching a second end of said support rail to the item of furniture, an entirety of said second fixing device being detachably connected to said second end of said support rail;

wherein at least one of said first fixing device and said second fixing device includes:

a mounting portion to be fixed to the item of furniture, said mounting portion having a base surface adjacent to and facing the item of furniture;

a bearing portion detachably connected to said support rail; and an arresting device for releasably and adjustably clamping said mounting portion to said bearing portion, said arresting device being configured so that, in a first operating position of said arresting device, said arresting device is disengaged from at least one of said mounting portion and said bearing portion so as to allow said bearing portion to slide freely relative to said mounting portion and along said mounting portion in a sliding direction toward and away from said base surface of said mounting portion and, in a second operating position of said arresting device, said arresting device engages both of said mounting portion and said bearing portion so as to lock a position of said bearing portion relative to said mounting portion.

15. The support construction according to claim 14, wherein said bearing portion is a separate and discrete component with respect to said support rail.

16. The support construction according to claim 14, wherein said bearing portion is configured and arranged so as to have limited movement relative to said mounting portion in said sliding direction, said sliding direction extending approximately at a right angle to a longitudinal axis of said support rail.

17. The support construction according to claim 14, wherein said mounting portion and said bearing portion are configured to allow said bearing portion to slide only in said sliding direction toward and away from said base surface of said mounting portion when said arresting device is disengaged from at least one of said mounting portion and said bearing portion.

18. The support construction according to claim 17, wherein said bearing portion has at least one groove for receiving said mounting portion therein, said at least one groove being configured to allow said bearing portion to slide within said at least one groove only in said sliding direction relative to said mounting portion.

* * * * *